US006471465B2

(12) United States Patent
Albertyn

(10) Patent No.: US 6,471,465 B2
(45) Date of Patent: Oct. 29, 2002

(54) FORKLIFT BLADE COVER

(76) Inventor: Colin Albertyn, Plot 109, Runnymead Street, Chartwell Johannesburg (ZA)

( * ) Notice: Subject to any disclaimer, the term of this patent is extended or adjusted under 35 U.S.C. 154(b) by 0 days.

(21) Appl. No.: 09/812,506

(22) Filed: Mar. 20, 2001

(65) Prior Publication Data

US 2002/0136627 A1 Sep. 26, 2002

(51) Int. Cl.[7] ..... B66F 9/12
(52) U.S. Cl. ..... 414/785; 414/607
(58) Field of Search ..... 414/785, 607

(56) References Cited

U.S. PATENT DOCUMENTS 1,836,576 A * 12/1931 Chalmers ..... 294/82.1
2,282,201 A 5/1942 Neuman
3,381,937 A * 5/1968 Zillman ..... 414/607 X
5,221,176 A * 6/1993 Allen et al. ..... 414/785
5,575,608 A * 11/1996 Yau et al. ..... 414/607

FOREIGN PATENT DOCUMENTS

DE 2300689 7/1974
RU 1703612 * 1/1992 ..... 414/607

* cited by examiner

*Primary Examiner*—Steven A. Bratlie
(74) *Attorney, Agent, or Firm*—Iandiorio & Teska

(57) ABSTRACT

A protective device for the free end of a tine of a forklift truck, in which a polymeric body is adapted to accommodate the end edge of a forklift truck tine. This protective device includes a forward end region that operatively obscures the end edge of the associated tine and a rearward extending portion that is adopted for securing the protective device to a forklift truck tine by bonding, fasteners, or in any other suitable manner.

10 Claims, 5 Drawing Sheets

FORKLIFT BLADE COVER

FIELD OF THE INVENTION

This invention relates to a forklift truck accessory and, more particularly, to a protective device for preventing, or at least diminishing, possible damage which can be caused by a forklift truck.

BACKGROUND TO THE INVENTION

The laterally spaced pair of load bearing tines of a forklift truck usually have fairly narrow bade-like ends which may vary in thickness from 2 mm to about 15 mm.

Forklift trucks are often required to be manoeuvred in narrow isles and in other confined areas. As a result of this, and the difficulty of accurately gauging the exact location of, in particular, elevated forklift tines, it is not uncommon that damage to products on pallets, and to pallets themselves is caused by these tines.

Furthermore, in the case of smaller pallets, the tines can extend right through the pallet to project outwardly on the other side and, in such a case, the forklift truck driver has virtually no sight of the free ends of the tines and is thus not sure where they are located, thus increasing the possibility of damage to surrounding product, pallets, and even the building or storage system itself.

OBJECT OF THE INVENTION

It is an object of this invention to provide a protective device which will assist in at least alleviating the occurrence of such damage.

SUMMARY OF THE INVENTION

Accordingly, the present invention provides a protective device for a free end of a tine of a forklift truck, the protective device comprising a molded polymeric body having:

(i) a forward end region which is for obscuring the free end of the tine and which is substantially thicker than the end of the tine for absorbing impact of the tine with objects;

(ii) a rearwardly extending portion which extends rearwardly of the forward end region and which tapers inwardly on all sides towards the tine such that the rearwardly extending portion joins the tine in a substantially smooth manner and substantially without the formation of a step; and (iii) a slot which extends into the molded polymeric body from an end of the protective device which is opposite the forward end region, the slot receiving the free end of the tine, and the slot having open sides extending parallel to longitudinally extending sides of the tine whereby the protective device is able to fit over tines of different sizes;

and the molded polymeric body being constructed for securing to the tine by bonding.

The overall thickness of the forward end region of the molded polymeric body is such that it fits easily into spaces for receiving the tine, for example the space between the upper and lower platforms of a pallet.

The protective device may be one in which the upper and lower faces of the molded polymeric body contain metal plates.

The protective device may be one in which the upper and lower faces of the molded polymeric body have rearwardly extending grooves therein. The rearwardly extending grooves may minimise friction between the surface of the molded polymeric body, and an object such for example as a pallet.

If desired, the forward end region of the molded polymeric body may be contoured to facilitate introduction of the protective device into a space.

The molded polymeric body may be molded from an elastomeric material. The elastomeric material is preferably selected from rubber and polyurethane.

Preferably, the color of the protective device is one associated with safety.

The present invention also extends to the combination of a tine of a forklift truck and the protective device.

DETAILED DESCRIPTION WITH REFERENCE TO THE DRAWINGS

Figure 1:
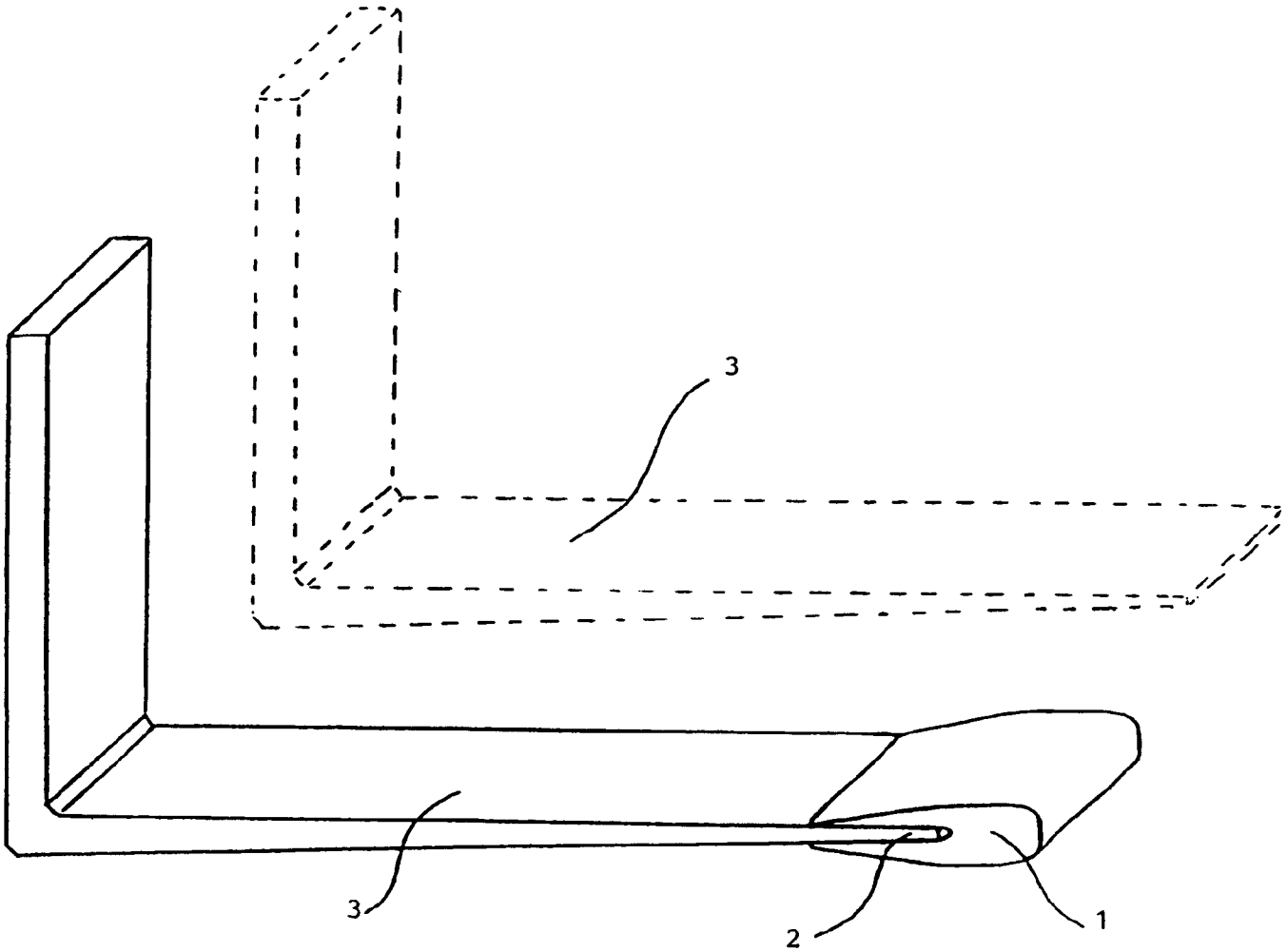
FIG. 1 is an oblique view of a typical pair of load bearing tines of a forklift truck illustrating, in one case, a protective device according to the invention.

As illustrated in FIG. 1 the protective device (1) according to the invention is adapted to be fitted over the free end (2) of a load bearing tine (3) of a forklift truck.

Figure 2:
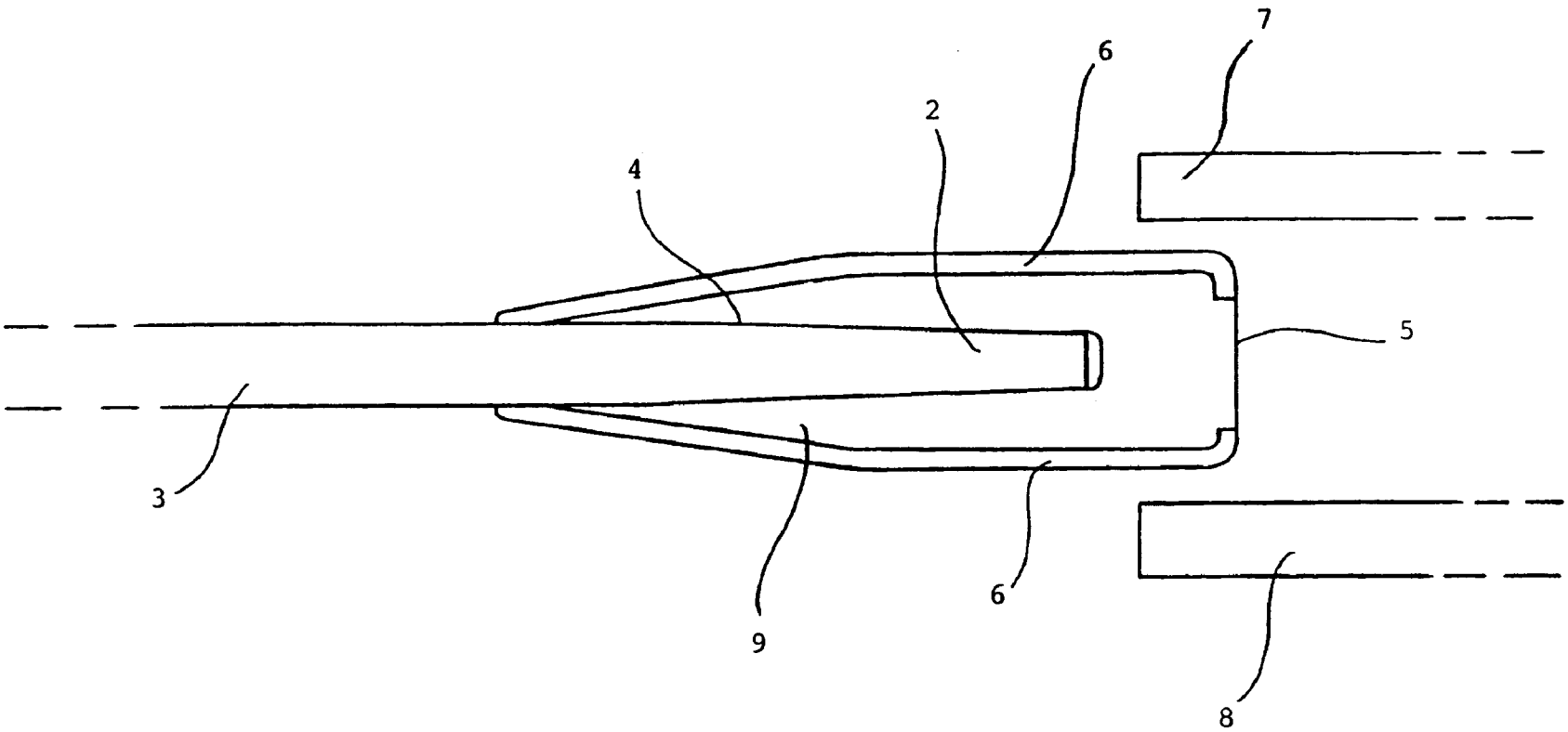
FIG. 2 is a sectional side elevation of a load bearing tine end fitted with one form of protective device according to the invention.

FIG. 2 shows a protective device having a slot (4) formed therein for accommodating the end (2) of the tine. The protective device is molded basically from a suitable rubber, or other polymeric material such for example as a suitably robust but resilient polyurethane material. A front end (5) of the protective device has the polymeric material exposed, but upper and lower faces of the protective device are defined by metal plates (6) which serve to slide against upper and lower platforms (7) and (8) of a pallet as indicated in FIG. 2.

The protective device is bonded to the tine end using a suitable adhesive material.

Clearly the entire height of the protective device is such that little or no difficulty will be experienced by a driver of a forklift truck in introducing the tine ends between the upper and lower platforms of a pallet.

The upper and lower faces of the device taper towards the tine's surface in a rearward position, as indicated by numeral (9), to ensure that the tine can be easily removed from a pallet without fouling same.

In use, it will be understood that the blunt, resilient forward end of the protective device will substantially prevent damage to items inadvertently engaged thereby, thus obviating the difficulties outlined above, at least to a substantial extent.

Figure 3:
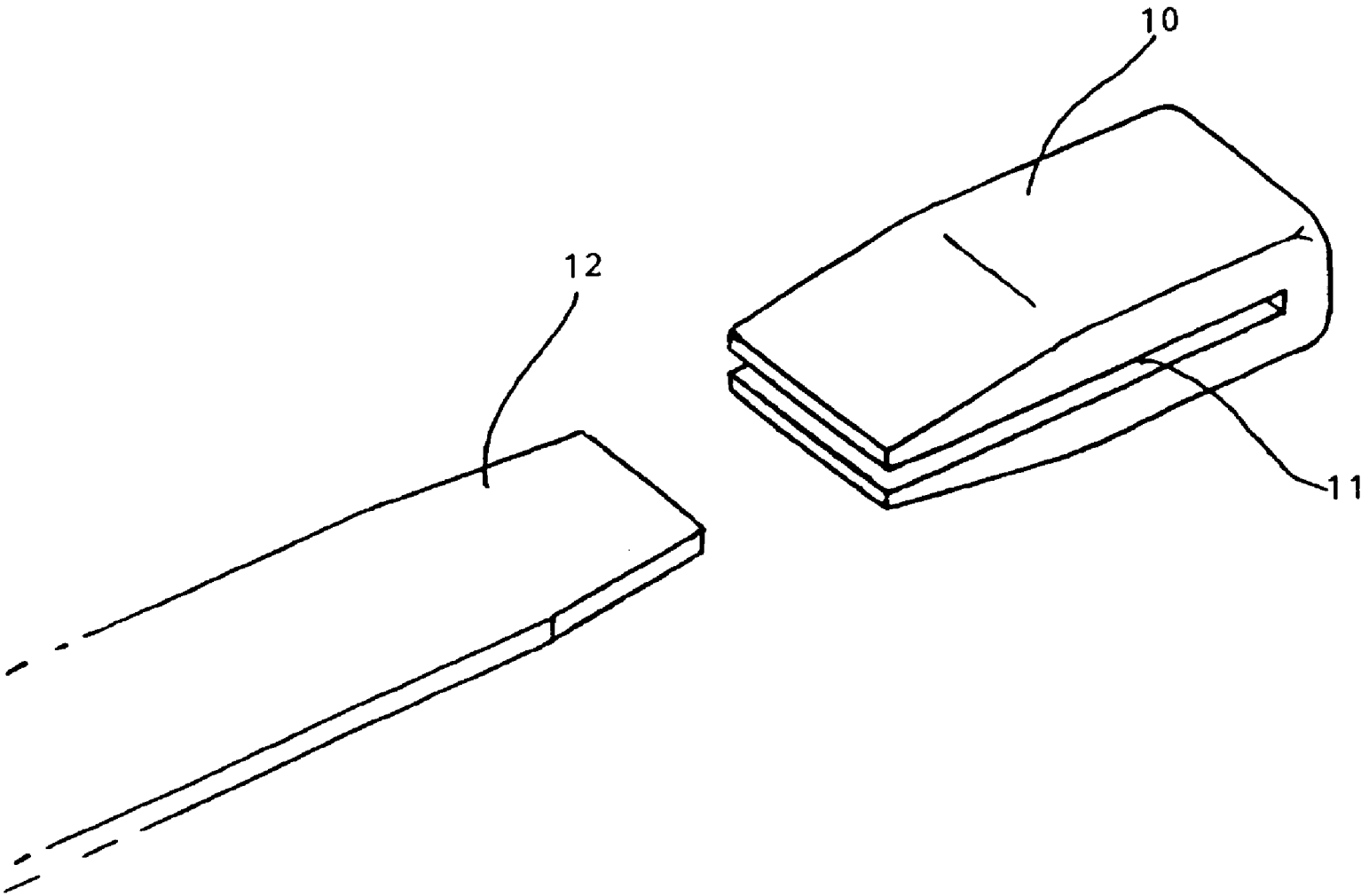
FIG. 3 is an exploded isometric view illustrating an alternative and simplified form of the invention of greater versatility.
Figure 4:
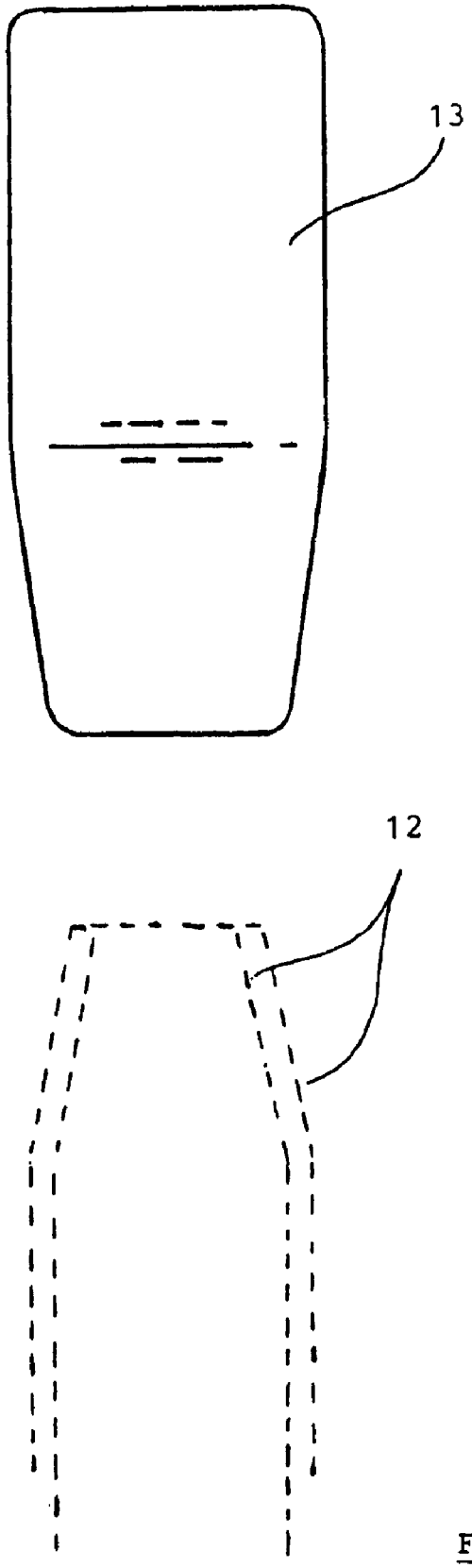
FIG. 4 is a plan, view of the embodiment of the invention illustrated in FIG. 3 and indicating its versatility; and, FIG. 5 is an oblique view of a tine having an alternative device according to the invention with a surface configured to decrease friction between a pallet and the body.

In the embodiment of the invention illustrated in FIGS. 3 and 4, the protective device has a molded body (10) similar to that described above but without the metal plates. A slot (11) is deeper than the slot (4).

The provision of a slot in the protective device of the invention is highly advantageous in that it enables one size of protective device to be installed on a number of different sizes of forklift truck tines (12), as shown in dotted lines in FIG. 4. Also as shown in FIG. 4, the body tapers in plan view somewhat towards its rear end (13) so that, when installed on a narrower tine, there will be no projecting corners which could foul on the edges of pallets or the like, particularly when the tines are withdrawn therefrom.

Figure 5:
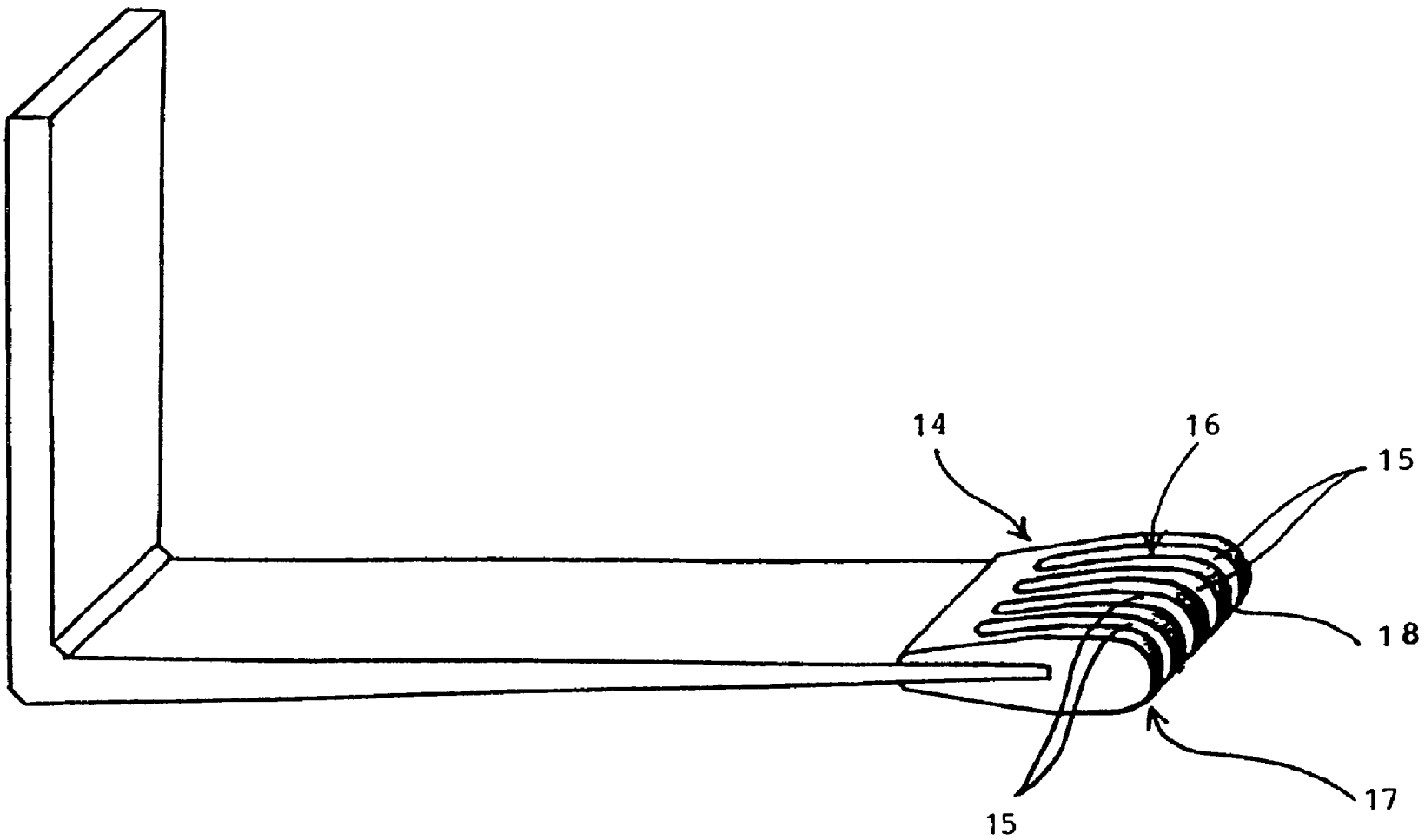

Turning now to the embodiment of the invention illustrated in FIG. 5, there is illustrated an embodiment of the invention substantially the same as is illustrated in FIG. 1 but with upper and lower surfaces configured to decrease friction between the device body and a pallet or other object which it may contact. In this case the moulded polymeric body (14) has deep rearwardly extending grooves (15) in its upper and lower surfaces (16) and (17) as well as in its front end (18). This has the effect of decreasing the area of contact between the surface, and, for example that of a pallet, with the result that there is a decrease in the tendency for the device to push, as a consequence of frictional contact, the pallet around unintentionally.

In all of the embodiments of the invention, the body is preferably made to an eye catching color such as a bright yellow or orange.

Numerous variations may be made to the embodiments of the invention described above without departing from the scope hereof which is limited only to the provision of an appropriately blunt protective device for the front ends of forklift tines.

What is claimed is:

1. A protective device for a free end of a tine of a forklift truck, the protective device comprising a molded polymeric body having:

(i) a forward end region which is for obscuring the free end of the tine and which is substantially thicker than the end of the tine for absorbing impact of the tine with objects;

(ii) a rearwardly extending portion which extends rearwardly of the forward end region and which tapers inwardly on all sides towards the tine such that the rearwardly extending portion joins the tine in a substantially smooth manner and substantially without the formation of a step; and (iii) a slot which extends into the molded polymeric body from an end of the protective device which is opposite the forward end region, the slot receiving the free end of the tine, and the slot having open sides extending parallel to longitudinally extending sides of the tine whereby the protective device is able to fit over tines of different sizes;

and the molded polymeric body being constructed for securing to the tine by bonding.

2. A protective device according to claim 1 in which upper and lower faces of the molded polymeric body contain metal plates.

3. A protective device according to claim 1 in which upper and lower faces of the molded polymeric body have rearwardly extending grooves therein.

4. A protective device according to claim 1 in which the forward end region of the molded polymeric body is contoured to facilitate introduction of the protective device into a space.

5. A protective device according to claim 1 which the molded polymeric body is molded from an elastomeric material.

6. A protective device according to claim 5 in which the elastomeric material is selected from rubber and polyurethane.

7. The combination of a tine of a forklift truck and a protective device on a free end of the tine, the protective device comprising a molded polymeric body having:

(i) a forward end region which is for obscuring the free end of the tine and which is substantially thicker than the end of the tine for absorbing impact of the tine with objects;

(ii) a rearwardly extending portion which extends rearwardly of the forward end region and which tapers inwardly on all sides towards the tine such that the rearwardly extending portion joins the tine in a substantially smooth manner and substantially without the formation of a step; and (iii) a slot which extends into the molded polymeric body from an end of the protective device which is opposite the forward end region, the slot receiving the free end of the tine, and the slot having open sides extending parallel to longitudinally extending sides of the tine whereby the protective device is able to fit over tines of different sizes;

and the molded polymeric body being secured to the tine by bonding.

8. The combination of claim 7 in which the upper and lower faces of the molded polymeric body contain metal plates.

9. The combination of claim 7 in which the upper and lower faces of the molded polymeric body have rearwardly extending grooves therein.

10. The combination of claim 7 in which the molded polymeric body is molded from an elastomeric material selected from rubber and polyurethane.

* * * * *